United States Patent [19]

Kugle et al.

[11] 4,081,109

[45] Mar. 28, 1978

[54] HAMMER SYSTEM FOR CEMENT METER

[75] Inventors: John L. Kugle; Robert C. Futty, both of Lancaster, Pa.

[73] Assignee: IRL Daffin Associates, Inc., Lancaster, Pa.

[21] Appl. No.: 695,025

[22] Filed: Jun. 11, 1976

[51] Int. Cl.[2] ..... B65G 65/70

[52] U.S. Cl. ..... 222/197; 222/221; 74/519; 366/31; 366/42

[58] Field of Search ..... 222/196, 197, 201, 217, 222/218, 219, 221, 222, 223, 224, 225, 233, 345, 346, 349, 350, 368; 259/9, 10, 109, 110, 169, 161, DIG. 42; 74/512, 513, 519, 522, 522.5

[56] References Cited

U.S. PATENT DOCUMENTS

| | | | |
|---|---|---|---|
| 1,431,410 | 10/1922 | Moran | 74/513 |
| 1,556,506 | 10/1925 | Fox | 74/519 |
| 3,269,375 | 8/1967 | Beal | 74/519 |
| 3,336,011 | 8/1967 | Futty | 259/148 |
| 3,401,678 | 9/1968 | Rose | 74/519 |
| 3,428,032 | 2/1969 | Rudert | 74/519 |

*Primary Examiner*—Robert B. Reeves
*Assistant Examiner*—H. Grant Skaggs
*Attorney, Agent, or Firm*—Holman & Stern

[57] ABSTRACT

A hammering system for a compartmented, rotary metering drum comprising an elongated member rotatably supported on bearings, a lever pivotably mounted on the elongated member, hammers mounted on one end portion of the lever, and a biasing mechanism secured to the other end portion of the lever urging the lever to pivot about its fulcrum to engage the hammers with the metering drum. The metering drum has cocking structures associated with the leading face of each vane on the drum which forces the hammers away from the drum and suddenly releases the hammers to subsequently strike the drum to knock away any caked material therefrom.

4 Claims, 3 Drawing Figures

HAMMER SYSTEM FOR CEMENT METER

BACKGROUND OF THE INVENTION

This invention relates to a hammer system, and more particularly relates to a hammer system for use in conjunction with a compartmented rotary cement metering drum.

Cement is a hygroscopic material and consequently any cement metering system must have provisions for breaking loose any caking of the cement on the metering surface. Various prior art devices have been developed to break loose caked cement. Generally, these devices are in the form of a hammering system.

A number of these hammer systems shake or beat the entire bin from which the cement is to be metered. Such systems waste energy insofar as the cement which is caked on the metering system is concerned because the vibrations generated by the beating are not specifically directed at the point at which the problem is most acute, namely, in the metering system itself. A prior art hammer system which is specifically directed at breaking loose caked cement in the metering system is shown in commonly assigned U.S. Pat. No. 3,336,011. This system comprises spring elements, hammer elements supported on one end of the spring elements, and a shaft upon which the spring elements are fixed. The hammer elements are bised into engagement with the surface of a compartmented rotary metering drum having vanes which are provided with inclined plane surfaces. As the drum rotates, the hammer elements are displaced by the inclined surfaces thereby causing the springs to be placed under added stress. As the metering drum continues to rotate, the hammer members are freed from engagement with the inclined plane surfaces and impart a hammer blow to the metering drum releasing any cement which may have become caked thereon. Although this system is commercially useful, it suffers from a number of disadvantages. The spring elements after numerous cycles of operation tend to lose their spring and/or break. The breakage most often occurs at the junction of the hammer element with the spring element. High-quality spring steel is necessary to manufacture the spring elements and thus they are costly to replace. Additionally, a hammer system of this nature is inherently not adjustable.

OBJECTS OF THE INVENTION

It is a primary object of the present invention to provide a hammer system which overcomes the aforementioned difficulties of the systems of the prior art.

It is a further object of the present invention to provide a simple, inexpensive, and sturdy apparatus as a hammer system for a cement metering system.

Another object of this invention is the provision of a hammer system which is directed precisely at the point where it is needed to break loose the caked cement.

A still further object of the present invention is to provide a hammer system having easily replacable hammers.

A still further object of this invention is to provide a hammer system of the type described which is simple and inexpensive to manufacture and repair, sturdy and durable in construction, and highly efficient in operation.

BRIEF DESCRIPTION OF THE DRAWINGS

These and other objects and the attendant advantages of the present invention will become readily apparent by reference to the following detailed description when considered in conjunction with the accompanying drawings wherein.

Like reference characters refer to like parts throughout the several views of the drawings.

DETAILED DESCRIPTION OF A PREFERRED EMBODIMENT

Figure 1:
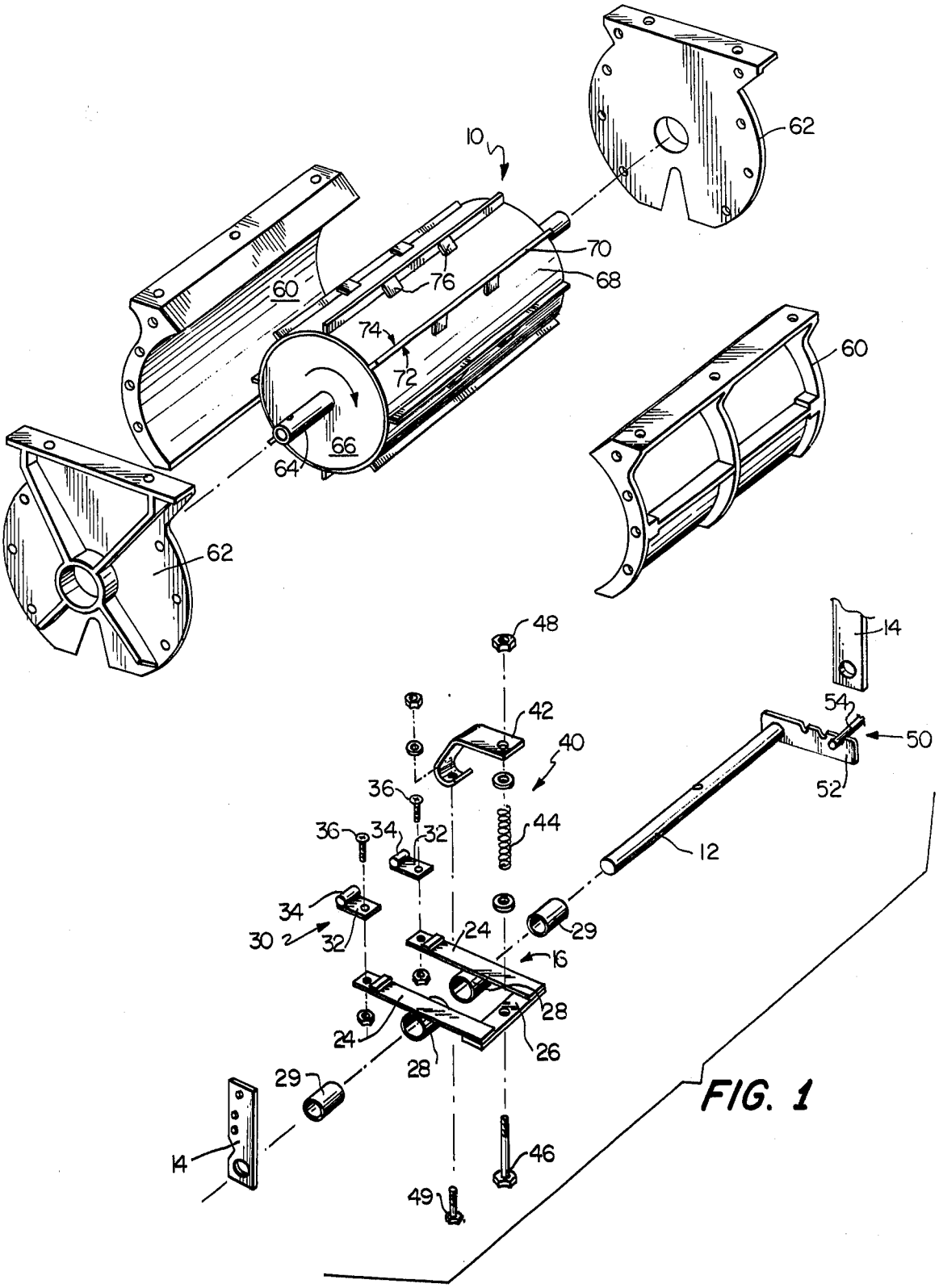
FIG. 1 is an exploded, perspective view of the apparatus of the present invention in use with a compartmented cement metering system.

The present invention is illustrated in use with a compartmented, rotary, metering drum 10. The hammer system comprises an elongated member 12, bearing means 14 supporting the elongated member 12 at its opposite ends, a lever means 16 rotatably mounted on the elongated member 12 and carrying hammer means 30, and a biasing means 40 forcing the hammer means 30 towards the drum 10.

The compartmented rotary metering drum 10 is shown as part of a cement metering system as described in U.S. Pat No. 3,310,293, the disclosure of which is incorporated herein in its entirety. This metering system comprises an arcuately walled discharge compartment attached to a storage bin (not shown). The discharge compartment is made up of a pair of arcuate walls 60 and a pair of appropriatelyshaped end plates 62. Within the discharge compartment is a metering drum 10 rotatably mounted on a shaft 64 extending through the compartment. The drum 10 comprises a core portion 66 having a cylindrical surface 68 with a plurality of vanes 70 extending radially from the core portion 66 towards the arcuate walls 60 of the compartment. Each vane 70 has a leading face 72 and a trailing face 74. The trailing face 74 of each vane 70 in combination with the leading face 72 of the next succeeding vane 70, the cylindrical surface 68 of the core portion 66 therebetween and the inner surfaces of the arcuate walls 60 define individual metering compartments. As the cement drops from the storage bin above, and the drum 10 rotates in the direction of the arrow in FIG. 1, a precise amount of cement is entrapped in each metering compartment and carried around to the bottom of the metering system whereupon the cement drops downwardly to be further processed. Occasionally, the cement will cake on the surface 68 of the metering drum 10 or bridge the leading and trailing faces 72, 74 of the vanes 70. The present invention is designed to break loose or preclude such caked cement.

The elongated member 12 is shown in the form of a cylindrical shaft. It is supported at either end by bearing means 14 which are illustratively shown as a pair of brackets. However, it should be understood that any suitable conventional means of rotatably supporting the elongated member 12 is within the scope of the present invention.

Figure 2:
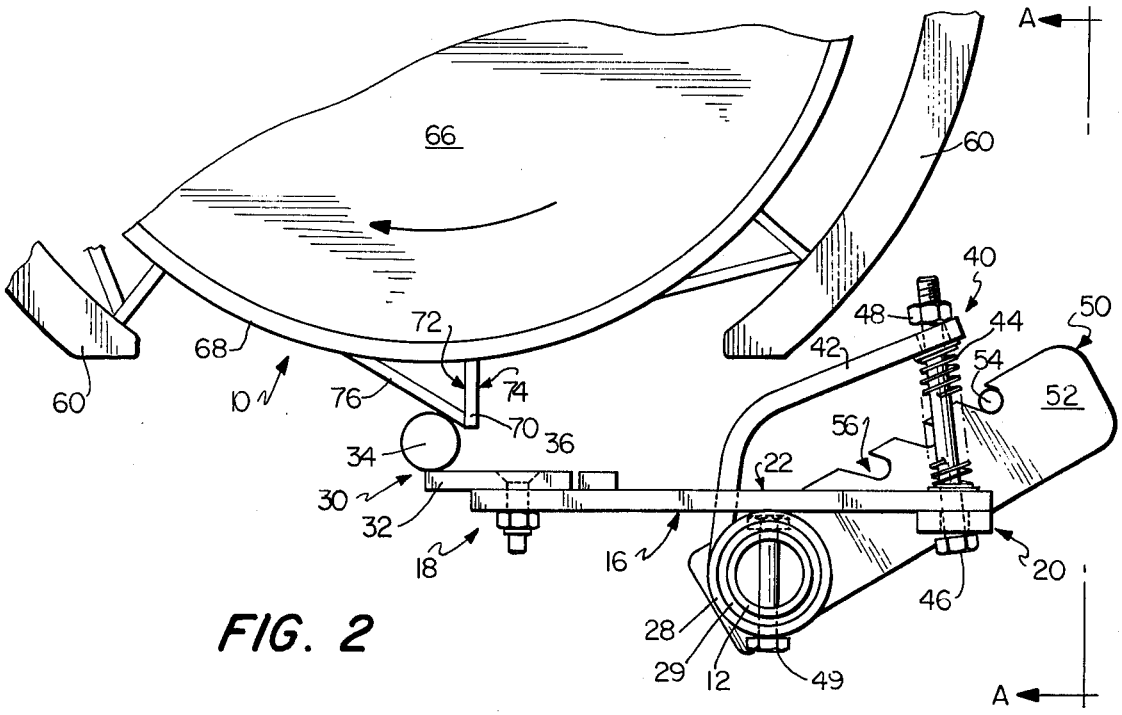
FIG. 2 is a side-elevation thereof.
Figure 3:
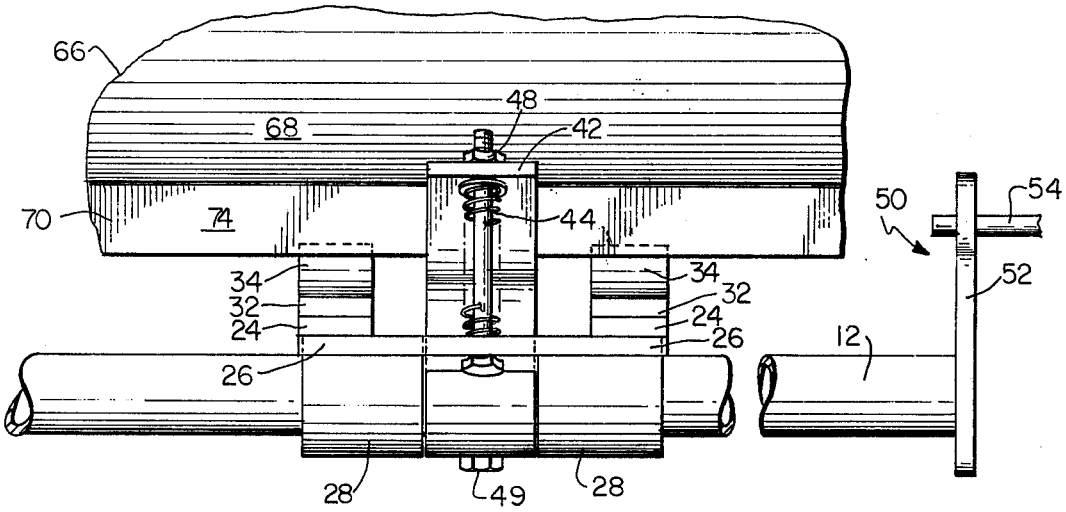
FIG. 3 is an end elevational view of the apparatus of the present invention taken along lines A—A of FIG. 2.

The lever means 16 comprises a first end portion 18, a second end portion 20, and a fulcrum point 22 about which the lever means is free to rotate. (Note particularly FIG. 2.) In the drawings, the lever means 16 is shown in the form of a U-shaped member comprising two rigid lever arms 24 and a connecting member 26. These are rotatably mounted on the mounting means 28 in the form of hollow cylinders resting on a bushing means 29 which in turn rests on the elongated member 12. One end of each rigid lever arm 24 and the connecting member 26 together form the second end portion 20 of the lever means 16, as shown.

At the other end of each lever arm 24, forming the first end portion 18 of the lever means 16, is mounted hammer means 30. The hammer means 30 comprises a hammer mount 32 shown in the form of a plate, a hammer head 34 shown in the form of a short piece of bar stock, and a means 36 for fastening the hammer mount 32 to the first end portion 18 of the lever arms 24, shown as a nut-and-bolt. Any other suitable means 36 for fastening the hammer mount 32 to the lever arm 24 would be within the concepts of the present invention. For example, welding would be suitable. Additionally, the hammer head 34 does not necessarily have to be cylindrical.

The biasing means 40 comprises a stop means 42, shown in the form of a rigid pivot arm fixedly secured to the elongated member 12 by means 49 of a nut-and-bolt, a spring means 44, shown in the form of a helical spring, and a bolt 46 and a nut 48 holding the spring means 44 in constant compression between the stop means 42 and the second end portion 20, centrally of the connecting member 26, of the lever means 16. Any other conventional means, such as welding or clamping, would be suitable for holding the spring means 44 in compression.

The hammer system further includes an adjustable means 50 secured to one end of the elongated member 12. The adjustable means 50 comprises a lever arm 52 having a number of notches 56 cut therein and a stop pin 54, secured to a portion of the frame (not shown). The stop pin 54 rests in one of notches 56 thereby holding the lever arm 52 in position. This prevents the elongated member 12 from rotating freely in the bearing means 14. The biasing means 40 of the present invention can be adjusted in two manners. First, the nut 48 can be tightened down upon the bolt 46, thereby adding more compression to the spring means 44, or the lever arm 52 of the adjustable means 50 can be repositioned by further rotating the elongated member 12 about its axis and setting the stop pin 54 in a different notch 56. This repositioning of the lever arm 52 further adds compression to the spring means 44.

A pair of inclined plane surfaces 76 forming a cocking means are attached to the leading faces 72 of each vane 70 in the path of each hammer means 30. As the drum 10 is rotated, the hammer head 34 rides on the surface 68 of the drum 10. As each vane 70 approaches the hammer heads 34, the hammer heads 34 ride up upon the inclined plane surfaces 76 thereby being pushed away from the surface 68 of the drum 10. As soon as the drum 10 rotates far enough, the hammer heads 34 pass over the top of the vane 70 and are suddenly released. The compressive force of the spring means 44 on the second end portion 20 of the lever means 16 immediately forces the lever arms 24 to rotate about their pivot point 22 causing the hammer heads 34 to strike the drum surfaces 68 following the trailing face 74 of the vane 70. This breaks loose any caked cement.

As stated before, an excellent example of a concrete metering system with which the hammering system of the instant invention is particularly useful can be found in U.S. Pat. No. 3,310,293, which shows a Concrete Mixing and Delivery System. It should be understood, however, that although the present invention is shown in use with a cement metering system, it is equally and appropriately applicable and useful with any compartmented rotary metering system for any dry or semi-dry material that has a tendency to cake or bridge.

It is readily apparent that the above-described hammering system meets all of the objects mentioned above and also has the advantage of wide commercial utility.

We claim:

1. A hammer system, for use in combination with a compartmented rotary metering drum having a cylindrical surface divided into arcuate portions by vanes having leading and trailing faces defining each metering compartment, comprising:

an elongated member having opposite end portions, a middle portion and a longitudinally extending axis, bearing means supporting said elongated member at said opposite end portions;

lever means having a first end portion, a second end portion and a fulcrum point disposed therebetween;

said lever means comprising a U-shaped member including two rigid lever arms and a connecting member defining said second end portion;

mounting means secured to said lever means at said fulcrum point for rotatably mounting said lever means on said middle portion of said elongated member;

hammer means mounted on said first end portion of said lever means for imparting a hammer blow to the surface of the drum; and biasing means operatively associated with said second end portion of said lever means constantly urging said lever means to rotate about said elongated member to force said hammer means towards the drum;

said biasing means being secured to said elongated member and comprising a stop means and a spring means, said spring means being held in constant compression between said stop means and said connecting member;

when the drum is rotated, the leading face of one vane forces said first end portion of said lever means away from the surface of the drum thereby rotating said lever means about said axis of said elongated member against the urging of said biasing means whereupon the vane passes said first end portion, said first end portion is suddenly released, and said biasing means forces said lever means to rotate about said fulcrum point causing said hammer means to strike the drum.

2. The hammer system of claim 1 wherein said hammer means comprises two hammer mounts, two hammer heads each one secured to a hammer mount, and means for fastening said hammer mounts and hammer heads for fastening said hammer mounts and hammer heads to said first end portion of one lever arm.

3. In combination with a compartmented metering drum system, the hammer system of claim 1, wherein said compartmented metering drum system comprises an arcuately walled discharge compartment, a compartmented metering drum rotatably mounted in said compartment;

a shaft extending through said compartment, said drum being secured to said shaft for rotation therewith, said drum comprising a core portion having a cylindrical surface secured to said shaft, a plurality of vanes extending radially from said core portion toward the walls of said compartment defining a plurality of metering compartments therebetween, each vane having a leading and trailing face and cocking means associated with each vane for forcing said first end portion of said lever means away from said surface of said core portion, said cocking means comprising inclined plane surfaces on said leading faces of said vanes of said drum, said hammer means engaging said inclined plane surfaces as said drum rotates, whereupon as said hammer means reaches said trailing face of said vane, it is suddenly released.

4. The combination of claim 3 wherein said hammer means comprises two hammer mounts, two hammer heads each one secured to a hammer mount, and means for fastening said hammer mounts and hammer heads to said first end portion of one lever arm.

* * * * *